US005683269A

United States Patent [19]

Davis et al.

[11] Patent Number: 5,683,269

[45] Date of Patent: Nov. 4, 1997

[54] SHIELDED ELECTRICAL CONNECTOR WITH CABLE STRAIN RELIEF

[75] Inventors: Wayne Samuel Davis, Harrisburg; Michael Eugene Shirk, Grantville, both of Pa.

[73] Assignee: The Whitaker Corporation, Wilmington, Del.

[21] Appl. No.: 576,389

[22] Filed: Dec. 21, 1995

Related U.S. Application Data

[63] Continuation-in-part of Ser. No. 411,027, Mar. 27, 1995, abandoned.

[51] Int. Cl.[6] ..... H01R 13/648

[52] U.S. Cl. ..... 439/607; 439/610

[58] Field of Search ..... 439/101, 108, 439/607, 609, 610

[56] References Cited

U.S. PATENT DOCUMENTS

| | | | |
|---|---|---|---|
| 4,653,836 | 3/1987 | Peele | 339/143 R |
| 4,981,447 | 1/1991 | Ichitsubo | 439/607 |
| 5,030,140 | 7/1991 | Sugiyama | 439/607 |
| 5,123,859 | 6/1992 | Davis et al. | 439/405 |
| 5,158,481 | 10/1992 | Frantz | 439/607 |
| 5,162,000 | 11/1992 | Frantz | 439/607 |
| 5,273,459 | 12/1993 | Davis | 439/607 |
| 5,338,227 | 8/1994 | Nakamura | 439/607 |
| 5,342,216 | 8/1994 | Davis et al. | 439/362 |
| 5,409,400 | 4/1995 | Davis | 439/610 |
| 5,425,657 | 6/1995 | Davis et al. | 439/610 |
| 5,518,421 | 5/1996 | Davis | 439/607 |

FOREIGN PATENT DOCUMENTS

| | | | |
|---|---|---|---|
| 0501629 A1 | 9/1992 | European Pat. Off. | H01R 13/58 |
| 0608813 A2 | 8/1994 | European Pat. Off. | H01R 13/502 |
| 0735617 A1 | 10/1996 | European Pat. Off. | H01R 13/26 |
| WO 96/30971 | 10/1996 | WIPO | H01R 13/658 |

OTHER PUBLICATIONS

U.S. Patent Application Serial No. 08/008 269 filed Jan. 26, 1993 (Abstract and Drawings only included).

U.S. Patent Application Serial No. 08/411 137 filed Mar. 27, 1995 (Abstract and Drawings only included).

*Primary Examiner*—Hien Vu

*Attorney, Agent, or Firm*—Anton P. Ness

[57] ABSTRACT

A shielded cable connector (10) including a housing (12) rearward insertable into an enclosing body section (22) of a first shell (20). The first shell (20) includes a tab section (32) extending rearwardly to a cable strain relief site, and a second shell (34) is affixable to the first shell rearwardly of the body section (22) to cooperate with the tab section (32) to form a strain relief clamped to a jacketed cable portion. The first shell (20) is free of upstanding arms and thereby provides a clearance to align the housing (12) with the body section (22) to enable insertion thereinto, while the second shell (34) includes coextending arms (72) for confining the crimped cross-section to form a rectangular shape, and the end portions (76) of the arms (72) are formed around the tab section's side edges (54) and against its outer surface thereof upon crimping.

9 Claims, 5 Drawing Sheets

SHIELDED ELECTRICAL CONNECTOR WITH CABLE STRAIN RELIEF

RELATED APPLICATION INFORMATION

This is a Continuation-in-Part of U.S. Pat. No. application Ser. No. 08/411,027 filed Mar. 27, 1995 now abandoned.

FIELD OF THE INVENTION

The present invention relates to the field of electrical connectors and more particularly to cable strain reliefs thereof.

BACKGROUND OF THE INVENTION

Electrical connectors for terminating cables commonly provide for relieving strain by the cables on the terminations of the cable's conductors to respective terminals within the housing of the connector. Generally, such strain relief mechanisms clamp onto the outer cable jacket rearwardly of the housing, and in shielded connectors are provided by rearward portions of the metal shell that surrounds the housing and extends along a portion of the cable adjacent the housing.

A particular connector for a cable having four conductors within an outer jacket, is disclosed in U.S. patent application Ser. No. 08/411,027, with terminals and the terminal-receiving passageway arrangement of the housing disclosed in U.S. patent application Ser. No. 08/411,137 filed Mar. 27, 1995 and assigned to the assignee hereof. The shielding and cable strain relief is defined by two opposing shell members, a first one of which provides an elongate body section of rectangular cross-section that snugly surrounds an elongate housing of generally rectangular cross-section, and the front end half of the housing is reduced in height extending to the connector mating face with contact sections of the four terminals disposed in a common row.

The first shell member of Ser. No. 08/411,027 includes a tab portion extending rearwardly from the body section and having a planar intermediate section extending to a rearward tab section having a planar cable-engaging surface with upstanding arms on either side. A second shell member opposes the tab portion and also has an intermediate section extending to a rearward end portion having a generally flat cable-engaging surface and includes at its rearward end a pair of arms extending along inner surfaces of the arms of the first shell member. The rearward portions of the two shell members are pressed against the cable jacket from above and below by a tool, and are firmly clamped together against and around the cable as the tool forms end portions of the arms of the first member around and against curved outside surfaces of the second member at the bases of the upstanding arms thereof, while the end portions of the arms of the second member perforce bear against the curved inner surfaces at the bases of the arms of the first member. Further, the second shell's rearward end portion includes a raised embossment centrally of the cable-engaging surface to provide a central recess along the outer surface such that end portions of the arms of the first shell member are formed inwardly for a limited distance during crimping to assuredly clamp around the second shell member to resist incidental forces tending to pry apart the first and second shell members.

The coextending arms of both shell members define side walls of a generally rectangular cable-containing region that confines the crimped cable in a generally flattened rectangular cross-section of selected limited dimension ranges, with the four conductors generally disposed in a row within the outer cable jacket, to define a strain relief of the cable by the connector shells. The tool would have crimping surfaces of a particular shape and dimension adapted to crimp the shell members against the cable and form the arms of the first shell member around the second shell member, to define a generally rectangular cross-section of a particular size optimized for the particular cable.

One of the advantageous features of the connector of Ser. No. 08/411,027 is that the second shell member includes a positioning tab at its forward end, that, during assembly of the second shell member to the first, is insertable into a slot in the top surface of rear end portion of the first shell's body section to engage the rear end of the housing to urge the housing fully forwardly within the body section to abut inturned edges of the front end of the body section, thus assuring that the front end of the housing is precisely against the inturned edges to assure optimum electrical performance of the mated connector pair.

Since the desired width of the cable cross-section after crimping of the strain relief arrangement therearound, is less than the housing width, the upstanding arms of the first shell member are correspondingly less far apart than the width of the housing. Insertion of the housing into the body section from rearwardly thereof is accomplished by rotating the housing after partial insertion of the reduced height front half into the full height rear end of the body section, so that the rear end of the housing clears the end portions of the upstanding arms of the tab section of the first shell member, with a completely collinear orientation of the housing possible only after partial insertion.

It is desired to provide a shielded connector similar to that of U.S. Ser. No. 08/411,027 for use with the same cable and same terminals, but that provides the terminals in two rows of two terminals enclosed within a housing hood portion of generally square cross-section at the forward end, within a first shell body section of generally square cross-section fitting snugly around the housing, thereby defining a modified mating face that is different to prevent the possibility of being inadvertently mated with a receptacle connector that is desirably mated only with the shielded connector of Ser. No. 08/411,027.

It is further desired to provide for insertion of the thus-modified housing into the thus-modified body section of the first shell member, without modifying the length of the housing or modifying the length of the shell's body section while maintaining the snug fit around the housing at its rearward end, thus maintaining the advantageous housing positioning arrangement.

SUMMARY OF THE INVENTION

It is an objective to provide such a connector for a multiconductor cable that utilizes the terminals and terminal-receiving passageway cross-section of U.S. Ser. No. 08/411,137, and the same housing-positioning arrangement and the same connector length and same distance of the cable strain relief from the housing rearward end, and the same shell-crimping tooling as in U.S. Ser. No. 08/411,027 while defining a different mating face.

The present connector includes a dielectric housing insertable into a body section of a first or front shell from rearwardly thereof and adapted to receive along passageways thereof a plurality of terminals terminated onto ends of conductors of a multiconductor cable from rearwardly thereof. The housing provides a closed hood front portion with the passageways being arranged in two rows of two on opposed inner surfaces of the hood, and the housing and shell body section having a generally square configuration. Extending rearwardly from the first shell body section is a tab section having a planar intermediate section and a generally planar rearward end portion at the desired strain relief location having a generally flat transverse cable-engaging surface with no upstanding arms thereat, but including an embossment defining a recess into the outer surface centrally thereof.

A second or rear shell is associated with the tab section and will be positioned rearwardly of the first shell body section, as in U.S. Ser. No. 08/411,027, and the shells include the positioning tab and slot housing-positioning arrangement thereof. The second shell also includes a generally flat transverse cable-engaging surface opposed from the tab section, also along the jacketed cable. The second shell includes opposed upstanding arms to extend along sides of the cable and past side edges of the tab section, for the end portions to be formed around the curved side edges and into the recess of the tab section during crimping. Rearward end portions of the second shell and the first shell tab section will together be crimped around and to the outer jacket of the cable to define a cable strain relief, with the crimped multiconductor cable thereat having a generally flattened rectangular cross-section of controlled dimensions.

The housing and the shell body section must have complementary size and shape, such that the elongate housing must be essentially collinear prior to insertion with the housing-receiving cavity defined by the snugly-fitting first shell body section in order to be even initially inserted thereinto. The generally planar nature of the rearward tab portion provides a clearance permitting a fully collinear orientation of the housing with the first shell body section facilitating housing insertion thereinto, assisted by a slight outward angle and deflectability of the planar intermediate tab section. The second shell preferably includes an embossment along its cable-proximate inner surface opposed from the first shell tab section to maintain a crimped cross-sectional area equivalent to that of U.S. Ser. No. 08/411,027, to compensate for the absence of upstanding arms of the first shell tab section within upstanding arms of the second shell and adjacent the cable while maintaining the same crimp height.

It is an objective of the present invention to provide a cable connector of the type having an elongate housing of generally square cross-section insertable into a complementary enclosing shell member in a snug fit therewithin from rearwardly thereof, where the enclosing shell member includes an integral section extending rearwardly therefrom and adapted to facilitate establishing a cable strain relief aligned with the housing and located a distance therefrom less than the length of the housing while providing clearance by the connector shell member for collinearly positioning the housing rearward of the housing-receiving cavity of the enclosing shell.

It is an advantage of the present invention in providing a cable connector of the type having an elongate housing secured within a shield defined by a pair of shell members that also define a cable strain relief by means of a clamp established by clamping arms thereof defining a crimped cable cross-section of known area, where only one of the shell members includes a pair of clamping arms while maintaining the same tool-defined crimp height.

An embodiment of the present invention will now be disclosed by way of example with reference to the accompanying drawings.

DETAILED DESCRIPTION

Figure 1:
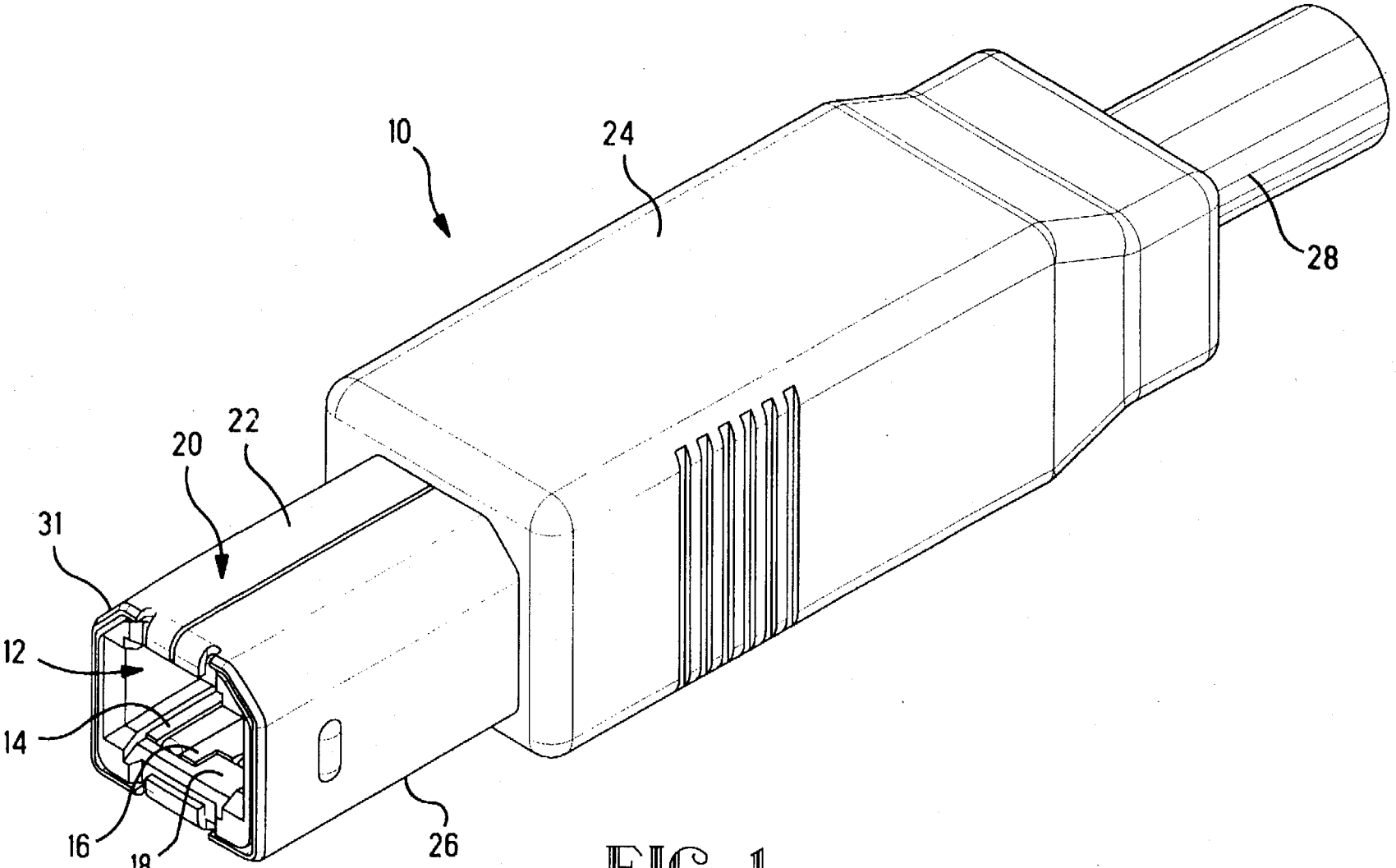
FIGS. 1 and 2 are isometric and exploded views of a plug connector of the present invention.
Figure 2:
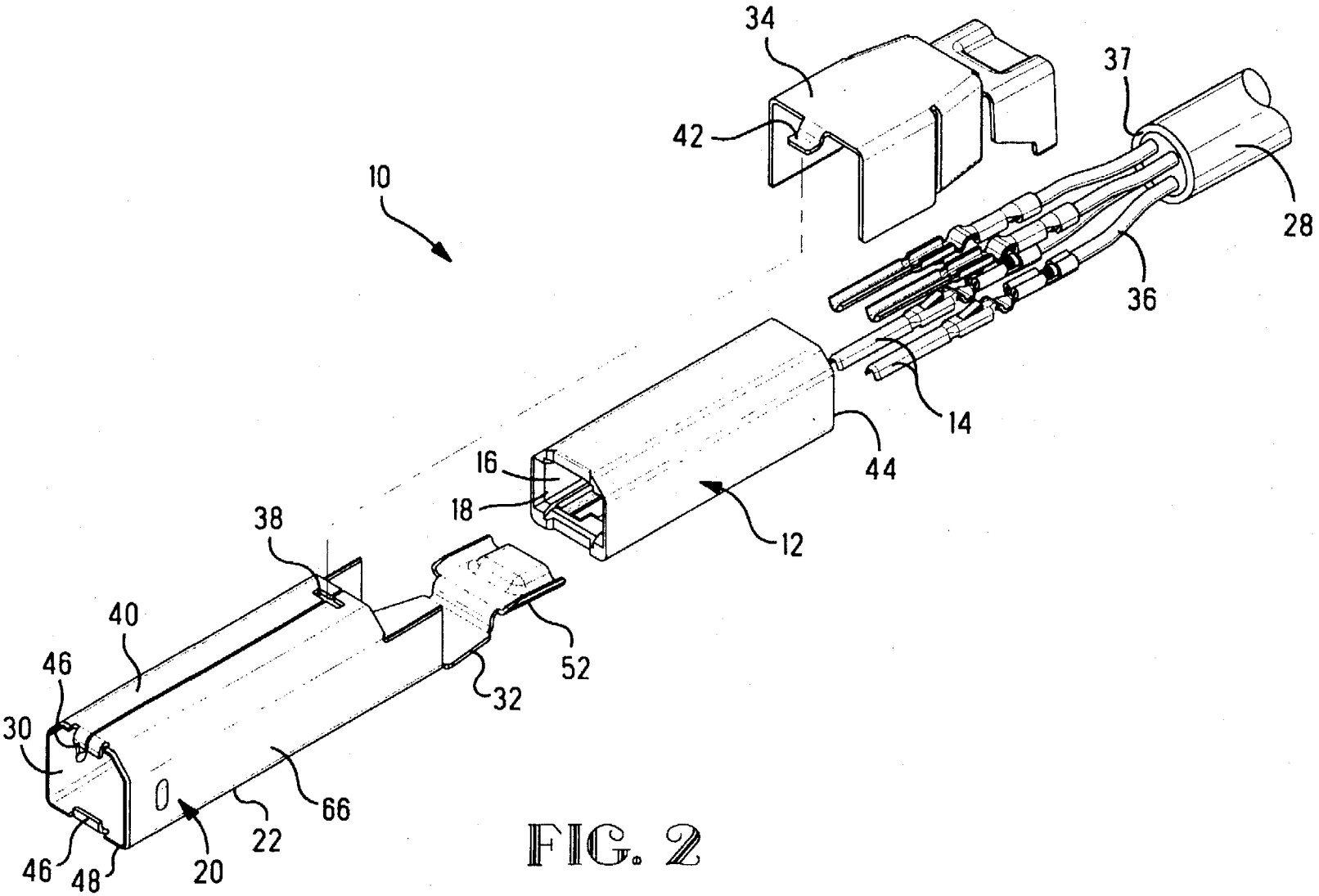

Plug connector 10 of the present invention is shown in FIGS. 1 and 2 and includes a dielectric housing 12 having a plurality of terminals 14 having contact sections thereof exposed within a cavity 16 of a front hood section 18 at the mating face to become electrically engaged with terminals of a complementary receptacle connector upon mating. Housing 12 is secured within a body section 22 of a first conductive shell 20, and an outer dielectric covering 24 has been molded around the plug connector 10 rearwardly of plug portion 26 receivable into a complementary receptacle connector, and also around a jacketed portion of multiconductor cable 28 extending rearwardly therefrom.

In FIG. 2, housing 12 is shown to be elongate with a generally square cross-section, complementary with the housing-receiving cavity 30 of body section 22 of first shell 20 within which it is to be disposed. The mating face of connector preferably includes a polarization feature such as angled corners 31. First shell 20 includes a tab section 32 extending rearwardly from body section 22. A second conductive shell 34 is seen that cooperates with tab section 32 to define a strain relief around the jacketed portion of cable 28 upon crimping, after terminals 14 terminated to discrete conductors 36 of cable 28 extending from the end of cable outer jacket 37, have been fully inserted into passageways of the housing. The terminals and the terminal-receiving passageway cross-sections preferably are as disclosed in U.S. Ser. No. 08/411,137.

Body section 22 includes a slot 38 adjacent the rearward edge of top surface 40, with top surface 40 being defined by end sections of the blank from which first shell 20 was formed in order to surround the housing. Positioning tab 42 of second shell 34 is insertable into slot 38 during assembly prior to crimping and serves to engage the rearward end 44 of housing 12 and urge the housing fully forwardly to abut inturned edges 46 at the forward end 48 of body section 22 of first shell 20, precisely positioning the housing axially fully forward with respect to the forward end of the body section (see FIG. 6) and maintaining the housing thereat during in-service connector use.

Figure 4:
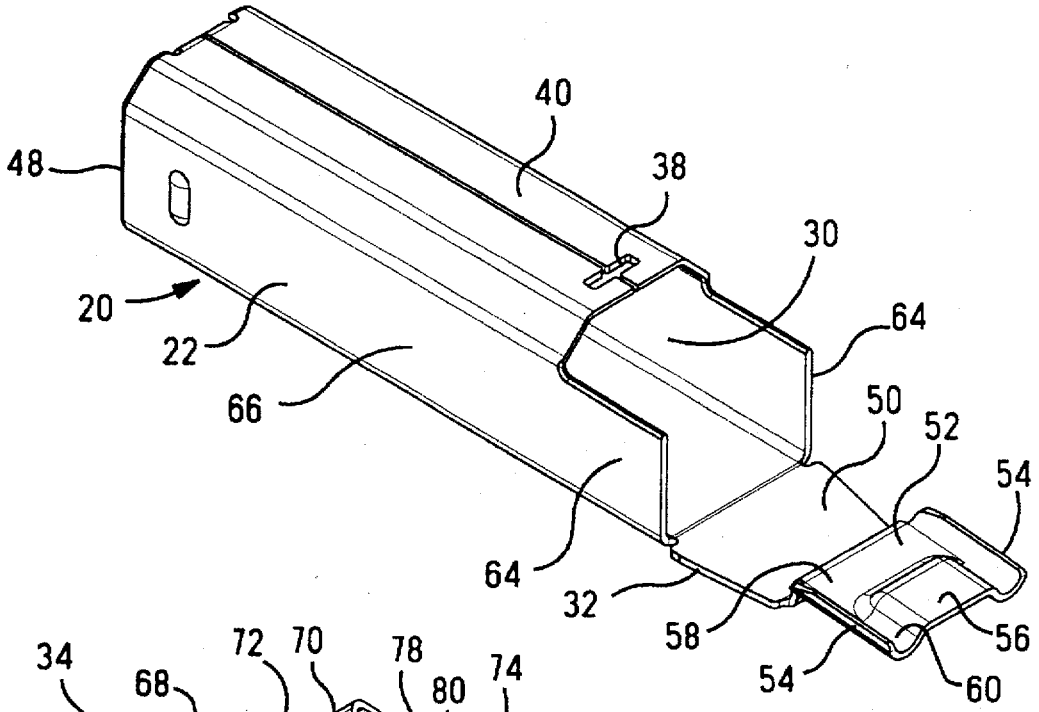
FIG. 4 is an isometric view of the first shell of the plug connector of FIGS. 1 and 2 from rearwardly thereof.
Figure 3:
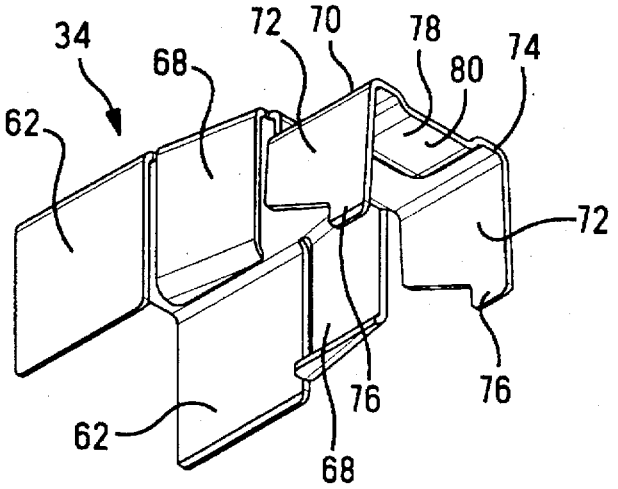
FIG. 3 is an isometric view of the second shell of the plug connector from rearwardly and below thereof.

Second shell 34 and the tab section 32 of first shell 20 are more clearly illustrated in FIGS. 3 and 4. Tab section 32 includes a planar intermediate section 50 extending to rearward section 52 slightly elevated with respect to intermediate tab section 50. Rearward tab section 52 is preferably raised with respect to intermediate tab section 50 and includes side edges 54 that are curved toward the cable-proximate direction and also an embossment 56 extending from the cable-proximate surface 58 at the rearward end 60 of tab section 32 with side edges 54 being substantially level with cable-proximate surface 58, and with rearward tab section 52 not including upstanding wall sections. Intermediate tab section 50 is preferably angled outwardly such as at about 5° or so. Second shell 34 includes first side wall sections 62 that coextend along outer surfaces of rearward portions 64 of side walls 66 of first shell 20, and second side wall sections 68 associated with intermediate tab section 50 of first shell 20 that will extend to free edges that will abut intermediate tab section 50 near or at the sides thereof upon crimping after assembly. Conductors 36 of cable 28 extend beyond an edge of the cable jacket 37 along intermediate tab section 50 and to terminals 14 of housing 12, in a connector transition region serving to permit adjustment of the relative conductor position from the terminal location in the housing to the location in the single row of conductors in the preferred ultimate crimped cable configuration at the strain relief at the rearward shell ends. It is seen that intermediate tab section 50 is substantially shorter than the length of housing 12 resulting in the distance between the rear face of the housing and the crimping region being substantially short, so that the connector assembly is relatively compact as in U.S. patent application Ser. No. 08/411,027.

Figure 5:
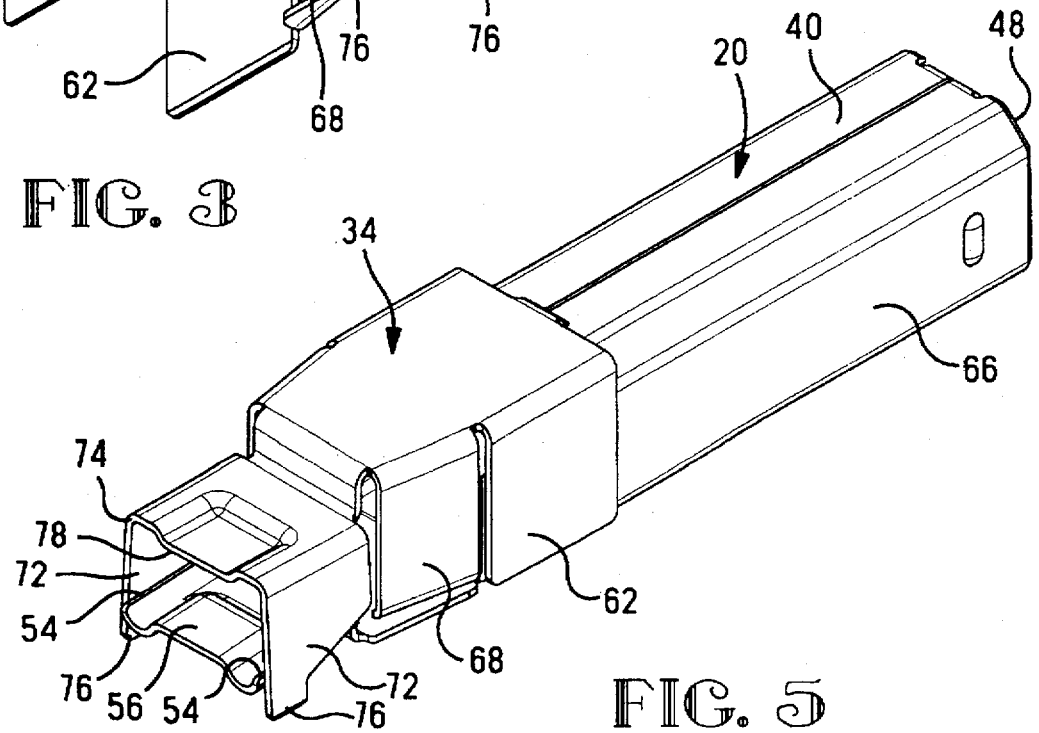
FIG. 5 is an illustration of the first and second shell members in position to be crimped together to define a cable strain relief during assembly.

Seen best in FIG. 5, rearward portion 70 of second shell 34 includes side walls or arms 72 separate from side wall sections 68 and that are elongated sufficiently at rear end 74 to extend to end portions 76 that will protrude beyond curved side edges 54 of rearward tab section 52 upon assembly. Embossment 78 is formed to protrude from cable-proximate surface 80 of rearward portion 70, generally opposing embossment 56 of first shell 20. Altogether, rearward portion 70 of second shell 34 and rearward tab section 52 of first shell 20 define a confined generally rectangular area to surround a jacketed cable portion upon complete assembly that will be crimped to define a cable strain relief. The desirable confined nature of the rectangular cable-surrounding area will limit the cross-sectional area of the crimp and determine its ultimate shape as well, one that is suitable to a four-conductor cable such as cable 28.

Figure 6:
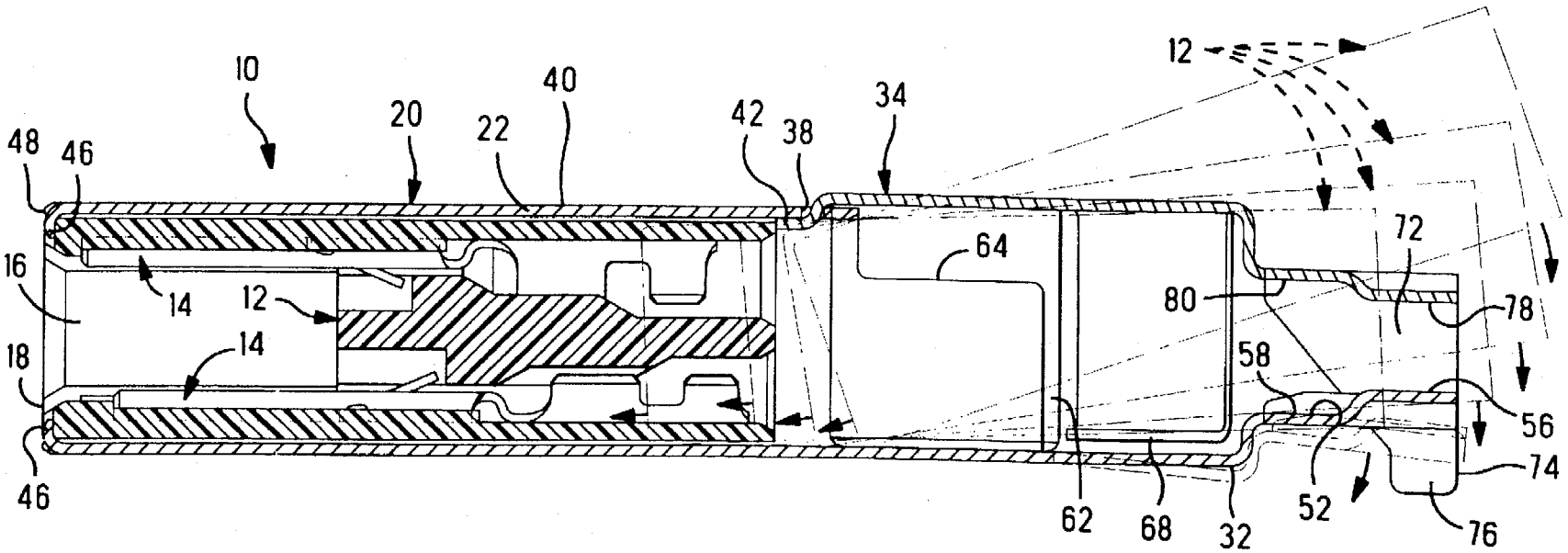
FIG. 6 is a longitudinal section view of the plug connector of FIG. 1 showing the housing fully inserted into the shells (and terminals therein) and also indicating the orientation of the housing when being inserted into the first shell.

In FIG. 6, housing 12 has been positioned within body section 22 of first shell 20, and second shell 34 has been assembled to first shell 20. Positioning tab 42 of second shell 34 has been received into slot 38 of first shell 20 and has engaged rearward end 44 of housing 12 and urged the housing fully forwardly until forward housing end has abutted inturned edges 46 of first shell 20 to accurately position the housing and its terminals 14 with respect to forward first shell end 48 and define the plug connector mating face.

Conductors 36 of cable 28 (to which terminals 14 are terminated) are not shown in FIG. 6 in order to more clearly demonstrate the process of inserting the housing 12 into the body section 22 of first shell 20. Housing 12 is generally square in cross-section and is desired to be elongate. During insertion into elongate, generally square body section 22 and prior to assembly of second shell 34 to first shell 20, housing 12 must be positioned collinear with housing-receiving cavity 30 of body section 22 rearwardly thereof and adjacent and along the cable-proximate surface of tab section 32. A limited amount of deflection of tab section 32 can occur at planar intermediate tab section 50 to provide clearance for housing 12, necessitated by abutment with raised rearward tab section 52 and embossment 56, with the deflection of the tab section and several positions of the housing shown in phantom.

Figure 9:
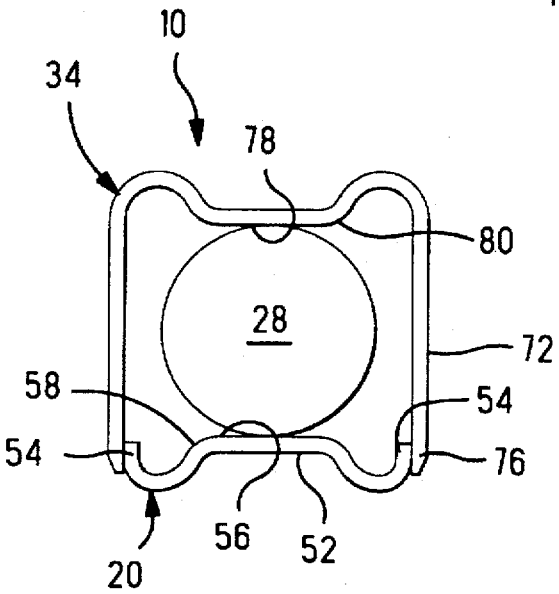
FIGS. 9 and 10 are diagrammatic cross-sections of the cable strain relief section of the present invention, similar to FIGS. 7 and 8, with FIG. 10 indicating that the crimp height is identical to that of FIG. 8.
Figure 10:
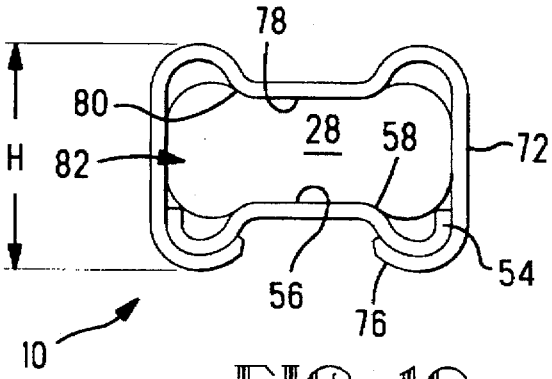

The cable strain relief arrangement of the present invention can best be set forth by comparison with the cable strain relief of the connector of U.S. Ser. No. 08/411,027, shown diagrammatically in FIGS. 7 and 8, with the present invention shown diagrammatically in FIGS. 9 and 10. Connector 100 includes a first shell 102 and a second shell 104, defining a confined generally rectangular area at the strain relief section surrounding a cable 106. Tab section 108 of first shell 102 is seen to include upstanding arms 110 joined to planar transverse section 112 thereof. Arms 114 of second shell 104 extend from transverse section 116 and are seen to extend along the inner surfaces of arms 110, and an embossment 118 extends from the cable-proximate surface of transverse section 116. As shown in FIG. 8, ends 120 of arms 110 are formed around and against the cable-remote surface 122 of transverse section 116 of second shell 104, and into the recess 124 defined by the formation of embossment 118, while ends 126 of arms 114 are constrained along inner surfaces of arms 110, all resulting in a generally flattened rectangular crimped cross-section 128 with a tool-defined crimp height H. In FIG. 9 is seen the arrangement of the present invention prior to crimping, and in FIG. 10 the crimp 82 has been defined, using the same tooling (not shown) and same crimp height setting thereof as for crimp 128. It may be seen that the tab section of the first shell is now the "inside" shell of the crimp 82 as contrasted with being the "outside" shell of FIGS. 7 and 8. Embossment 78 can be seen to compensate for the cross-sectional area previously occupied by inner arms 114 while maintaining crimp height H.

Figure 7:
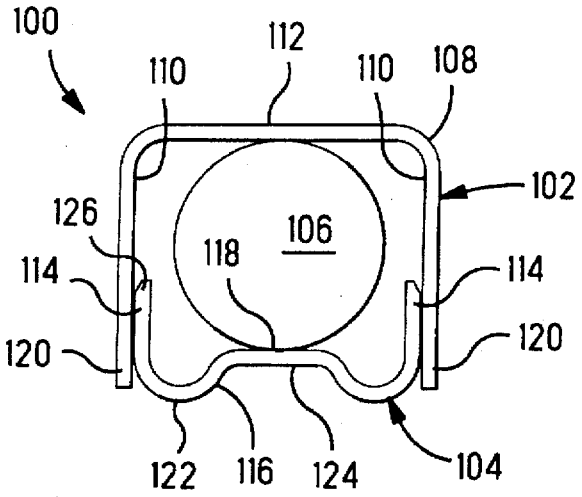
FIG. 7 is a diagrammatic cross-section of the cable strain relief section of the connector of U.S. Ser. No. 08/411,027, showing a cable in position between first and second shells thereof.
Figure 8:
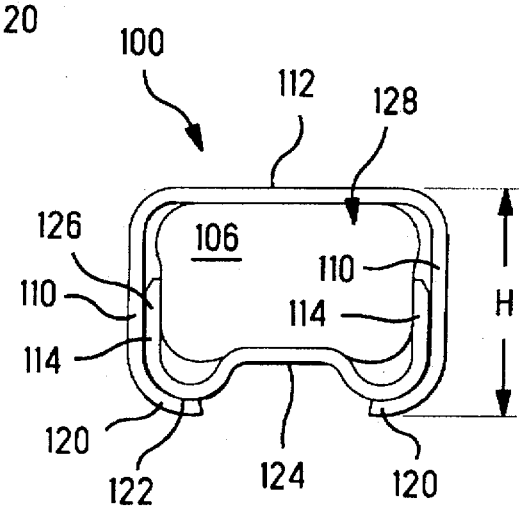
FIG. 8 is a diagrammatic cross-section of the cable strain relief arrangement of FIG. 7 after crimping.

The housing (not shown) for connector 100 of FIGS. 7 and 8 included a reduced dimensioned forward end that permitted assembly into the body section of first shell 102 while at a sufficient angle until partially inserted into its housing-receiving cavity, that sufficient clearance would be provided by the first shell tab section 108 above ends 120 of upstanding arms 110 prior to crimping. However, housing 12 of connector 10 is required to have a fully dimensioned forward end, one that is not reduced and presents difficulty in being inserted into a body section of the first shell, where the body section of the first shell with its proven shielding capability and optimum dimension and shape and inherent housing-positioning capability, is not permitted to be modified. The present invention resolves the problem and permits successful housing insertion, by modifying the cable-engaging portions of the tab section of the first shell while not altering the cross-sectional area of the crimp attained by the connector of U.S. Ser. No. 08/411,027.

What is claimed is:

1. A cable connector of the type having a housing enclosed within a shield structure including integral cable strain relief, comprising:

a dielectric housing of a selected length and including terminals disposed in passageways thereof and terminated to respective conductors of a cable;

a first conductive shell having a body section defining a housing-receiving cavity adapted to receive said housing thereinto in a snug fit, said body section having a bottom wall including a flat tab section extending rearwardly therefrom and substantially planar with said bottom wall, said bottom wall further having a rearward tab section connected to said flat tab section and located at a cable strain relief location spaced rearwardly from said body section;

a second conductive shell opposed from said tab section of said first shell and coextending to a rearward portion at said cable strain relief location;

said rearward tab section being generally flat and defining a first cable-proximate surface extending between upwardly curved side edges thereof, said side edges being substantially level with said first cable-proximate surface, and said rearward portion of said second shell being generally flat and defining a second cable-proximate surface and including a pair of arms coextending from side edges thereof to end portions and being of a length to extend past said edges of said rearward tab section and be formed around said rearward tab section side edges and at least partially therebeneath when said rearward tab section and said rearward portion of said second shell are crimped around a jacketed portion of the cable at said cable strain relief location.

2. A cable connector as set forth in claim 1 wherein said rearward tab section includes a recess into a cable-remote surface thereof at said cable strain relief location and centrally thereof such that said end portions of said rearward portion arms are formable into said recess during crimping.

3. A cable connector set forth in claim 1 wherein said tab section and said second shell include respective intermediate portions between said body section and said cable strain relief location, said respective intermediate portions being shorter than said length of said housing.

4. A cable connector as set forth in claim 3 wherein said intermediate portion of said first conductive shell is slightly angled outwardly transversely from said housing-receiving cavity.

5. A cable connector as set forth in claim 1 wherein said rearward portion of said second shell includes an embossment extending from a cable-proximate surface thereof and engageable with and compressible into said cable during crimping.

6. A cable connector as set forth in claim 1 wherein said housing is elongate and has a generally square cross-section and includes a hood portion as a front end thereof defining a cavity containing contact sections of said terminals exposed therein, and said first shell body section is complementary therewith for a snug fit of said housing therewithin.

7. A cable connector as set forth in claim 6 wherein a front end of said first shell body section includes inturned edges adjacent a front face of said housing and defining a forward stop for said housing during insertion into said housing-receiving cavity from rearwardly thereof.

8. A cable connector of the type having a pair of shell members disposed around a dielectric housing, the shell members including rearward portions adapted to be clamped around a jacketed cable portion therebetween by a preselected tool to form a crimped strain relief having a preselected crimp height and a crimped cross-section of selected area as a result of using of the tool, comprising:

the rearward portion of a first shell member having a flat tab section and a rearward tab section, said flat tab section and said rearward tab section being transverse and free of any upstanding arms, and the rearward portion of the second shell member being transverse and including a pair of upstanding arms, said upstanding arms extending from side edges of said rearward portion toward said first shell rearward tab section to end portions initially extending past the jacketed cable portion and beyond side edges of said first shell rearward tab section and adapted to be formed by the tool around said side edges of said first shell rearward tab section and against a cable remote surface thereof, wherein the side arms serve to confine the crimped cross-section to result in a rectangular cross-sectional shape when crimped by the tool, and the rearward portion of the first shell member defines a housing receiving cavity and provides a clearance for aligning the orientation of the housing alongside thereof to coincide with the housing-receiving cavity and thereby facilitating insertion of the housing into the housing receiving cavity.

9. The cable connector as set forth in claim 8 wherein said rearward tab section of said first shell member includes a raised embossment along a cable-proximate surface thereof resulting from said recess, and said rearward tab portion of said second shell member includes a raised embossment along a cable-proximate surface thereof to be compressed into said jacketed cable portion to compensate for the absence of arms of said first shell rearward section, while maintaining said preselected tool-defined crimp height such that said crimped cross-section includes an area equivalent to said selected area of said crimped cross-section when crimped by the preselected tool.

* * * * *